United States Patent [19]

Krapfenbauer et al.

[11] 4,116,032

[45] Sep. 26, 1978

[54] METHOD AND APPARATUS FOR MANUFACTURING STRAIGHT OR INCLINED TOOTHED MACHINE ELEMENTS, ESPECIALLY SPUR GEARS BY COLD WORKING

[75] Inventors: Hans Krapfenbauer, Zurich; Ernst Grob, Meilen, both of Switzerland

[73] Assignee: Ernst Grob, Mannedorf, Switzerland

[21] Appl. No.: 806,830

[22] Filed: Jun. 15, 1977

[30] Foreign Application Priority Data

Jun. 30, 1976 [CH] Switzerland ..... 8332/76

[51] Int. Cl.[2] ..... B21H 5/02

[52] U.S. Cl. ..... 72/68; 72/100; 72/110

[58] Field of Search ..... 72/68, 95, 100, 107, 72/108, 109, 110, 224, 225; 29/159.2

[56] References Cited

U.S. PATENT DOCUMENTS

| | | | |
|---|---|---|---|
| 2,679,089 | 5/1954 | Opitz et al. | 29/159.2 |
| 2,991,672 | 7/1961 | Meyer et al. | 72/100 |
| 3,261,172 | 7/1966 | Saito et al. | 29/159.2 |
| 3,461,701 | 8/1969 | Marcovitch | 72/110 |

*Primary Examiner*—Lowell A. Larson
*Attorney, Agent, or Firm*—Werner W. Kleeman

[57] ABSTRACT

A method of, and apparatus for, manufacturing straight or inclined toothed machine elements, especially spur gears, by cold working, which comprises holding under axial prestress a single gear-workpiece blank during a rolling or generating operation between two press punches at such a pressure that under the action of the rolling operation pressure stresses prevail between the press punches and the workpiece, these pressure stresses corresponding at least to the elastic limit of the workpiece material. Further, due to the simultaneous action of the prestressing force and the rolling operation there is formed at least at one of both end surfaces of the workpiece an end surface which is dispositioned exactly perpendicular to the axis of the workpiece.

17 Claims, 5 Drawing Figures

METHOD AND APPARATUS FOR MANUFACTURING STRAIGHT OR INCLINED TOOTHED MACHINE ELEMENTS, ESPECIALLY SPUR GEARS BY COLD WORKING

BACKGROUND OF THE INVENTION

The present invention relates to a new and improved method of, and apparatus for, manufacturing straight or inclined toothed machine elements, especially spur gears, by cold working or rolling.

Heretofore attempts to fabricate spur gears by cold rolling were principally carried out in two different ways:

According to a first technique the teeth were rolled at a rod-like blank, whereafter the individual gears were severed. What is disadvantageous with this method is the expensive pretreatment operations carried out upon the rod by grinding, something which is necessary in order to ensure for the proper guiding of the relatively long parts during rolling. Furthermore, the expensive further processing work carried out at the rolled rod by sawing and drilling as well as the loss of the rod ends, which possess too inaccurate teeth profile, had to be tolerated, with up to 70% of the blank having to be cut. Since the cutting work is inaccurate, the cut-off gear discs do not possess any exact axial contact surface for the further processing work, so that for the exact centering needed for the subsequent operations, for instance grinding of the bore, there was only available the possibility of reception in the pitch circle, for instance clamping by means of inserted roller bodies. In the case of relatively small gears this was particularly associated with extreme difficulties and rejection of the workpieces.

The second prior art technique contemplates rolling individual gears. Thus, due to axial flow of the material at the region of the teeth there is brought about a pronounced axial swelling of the material at the end surfaces of the gear. This in turn means that the teeth must be fabricated at the blank with large axial tolerances owing to the inaccuracies prevailing thereat, and which must be again cut-off following the rolling operation. With this procedure there is likewise unavailable any precise axial starting surface for the further processing operation following the rolling operation, and the procedure is uneconomical due to the cutting work.

For the reasons mentioned the rolling of individual gears has not been widely accepted in relation to the rod rolling technique. The rod rolling technique, in turn, has certain limitations concerning the economies of this process.

SUMMARY OF THE INVENTION

Hence, with the foregoing in mind it is a primary object of the present invention to provide a method of, and apparatus for, manufacturing straight or linear toothed machine elements, especially spur gears, by cold rolling, in a manner not associated with the aforementioned drawbacks and limitations of the prior art proposals.

Still a further significant object of the present invention aims at fabricating individual gears by cold rolling, while eliminating the drawbacks of the prior art techniques, especially as concerns inaccuracy, the relatively large cutting waste and the therewith associated increased work.

Another object of the present invention aims at the provision of an improved method of, and apparatus for, fabricating individual gears by cold rolling in a manner such that at least one end surface of the fabricated individual gear has formed thereat during the course of the cold rolling work a surface constituting a reference surface which is disposed exactly perpendicular to the axis of the workpiece and which reference surface is utilized for the subsequent processing or machining work, for instance the grinding of the bore.

Now in order to implement these and still further objects of the invention, which will become more readily apparent as the description proceeds, the inventive method for manufacturing straight or inclined toothed machine elements, especially spur gears, by cold rolling, comprises the steps of holding under axial prestress an individual gear-workpiece blank during the rolling operation between two press punches at such a pressure that under the action of the rolling operation there are produced pressure stresses between the work punches and the workpiece, these pressure stresses corresponding at least to the elastic limit of the workpiece material. Further, due to the simultaneous effect of the prestressing force and the rolling operation there is formed at least at one of both end surfaces of the workpiece an end surface dispositioned exactly perpendicular to the workpiece axis.

Since the workpiece is prestressed with the mentioned high pressure between the press punches at the region of the teeth, there can be at least suppressed for the most part an axial deviation of the material at the region or zone of the teeth. Furthermore, there is produced at the workpiece end surfaces which come into contact with the end surfaces of the punches, i.e., the workpiece end surfaces and related punch mutually contact one another through an angle extending through 360°, a surface which is disposed exactly perpendicular to the workpiece axis.

To the extent that a change of the contact force of the punch is not possible or desired, then for the determination of the contact pressure, for a given contact force of the punch, the contact surface can be appropriately selected.

For cold rolling there is utilized either radial rolling without axial feed or rolling with axially progressive mechanical working or shaping, for instance according to German Pat. No. 1,016,228, the disclosure of which is incorporated herein by reference. In the first mentioned case, according to the method of the invention, the workpiece can be chucked or clamped between two round punches, the outer diameter of which is approximately equal to the workpiece diameter. In the second mentioned case, the generating or rolling tool requires space for its insertion at the workpiece, and thus the punch, when used with the method aspects of the invention, must possess a contour corresponding to that of the teeth to be generated. This contour at most must be the same size and similarly shaped or somewhat smaller than the contour of the teeth to be produced at the workpiece. This difference in the construction of the outer contour of the press punch, which is employed in one case in the form of a round "disc" and in the other case, as a toothed element — depending upon the use of the one or other rolling technique — does not however necessitate any principal differences as concerns the inventive concepts. Hence, it will suffice in the description hereinafter to consider the method merely in terms of a rolling operation with axial feed and employing toothed press punches.

This rolling method can be basically carried out in the manner described in German Pat. No. 1,016,222, the disclosure of which is incorporated herein by reference, wherein for producing the profile by cold working of the workpiece, the workpiece is displaced along its lengthwise axis and rotated about such axis and worked externally by means of at least one ring-like profiled generating roll or roller. This so-called generating or teeth-forming roll is rotatably mounted in a revolving generating or rolling head and driven by such rolling head. With each generating roll or roller there is accomplished, during a predetermined rapid sequence accommodated to the profile pitch or division and the workpiece feed, sudden, i.e., briefly effective individual generating or rolling operations in the same directional sense and extending predominantly in the profile lengthwise direction. Consequently, with the same generating roll there can be successively carried out guided or controlled individual rolling operations at a helically-shaped zone of the workpiece surface adjacent one another in the peripherial direction, the helical-shaped zone being governed by the feed of the workpiece. By the same token, there is carried out in succession in the profile lengthwise direction individual rolling operations which overlap as concerns their application at the workpiece. These operations are accomplished such that during the individual rolling operations material is displaced along a relatively small lengthwise section of the workpiece predominantly in the radial direction.

In order to carry out the aforementioned method aspects in the just explained manner, there is also proposed, according to the invention, an apparatus for the performance thereof. Such apparatus comprises means for displacing the workpiece along its lengthwise axis and for rotating the workpiece about its lengthwise axis. Further, there is provided at least one generating or rolling head which is driven to revolve in a roll or rolling head support and there is provided therein at least one planetary-type mounted generating roll which can be driven by the rolling head support for machining the workpiece. Also, means serve to coordinate the movement of the workpiece and the generating roll. According to important aspects of the invention the apparatus further includes two press punches which can be tensioned or biased towards one another at the means for moving the workpiece. These two press punches in their contour possess teeth corresponding to the teeth which are to be fabricated and which at most correspond to the outer contour size of the mentioned teeth.

The punches can be tensioned or biased towards one another by a tie or traction rod interconnecting such along the workpiece axis or by the provision of means arranged externally of the workpiece. The latter technique is presently preferred and will be described more fully hereinafter, since such appreciably facilitates automation of the work and the employed forces are not limited by the dimensions of the workpiece.

Since it can happen that the shape of the workpiece in axial direction nearer to or further from the press punches does not correspond to what is desired, owing to the differences in the flowability of the material, when the engagement depth of the rolls at the workpiece is maintained constant or in order to form particular shapes, for instance crowning, the apparatus of the invention advantageously is equipped with a control device for adjusting the spacing of the impact heads — preferably two such impact heads being provided — from the workpiece axis.

Since with the mentioned preferred method technique the location of engagement or attack of the roller or roll at the workpiece proceeds along a helical or screw line, the attack of the roll at the workpiece in the peripheral direction is not completely uniform, so that there can occur rotation of the workpiece about its lengthwise axis. If the workpiece, during its feed, is engaged at its last machined end and displaced in the direction of the rolling tool, then this can result in a deviation of the teeth in the peripheral direction. On the other hand, if the workpiece is engaged at its already rolled end and drawn through the rolling or generating zone, then the rotation only always affects the not yet worked portion of the workpiece. Now in order to render possible, for carrying out the method of the invention, such "drawing" of the workpiece, the workpiece is preferably only driven by one press punch which neighbors the first machined workpiece end, whereas the second press punch freely moves along. In order to align the teeth of both press punches there can be employed an axially parallel bolt which interconnects such press punches. Such bolt is mounted to be sufficiently movable, preferably elastically movable, in one punch, in order to permit a small opposite rotation of the punches during rolling. With the inventive method it is thus possible, as a general rule, for the mobility of the mentioned alignment bolt to be adequate in a range of fractions of a millimeter.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
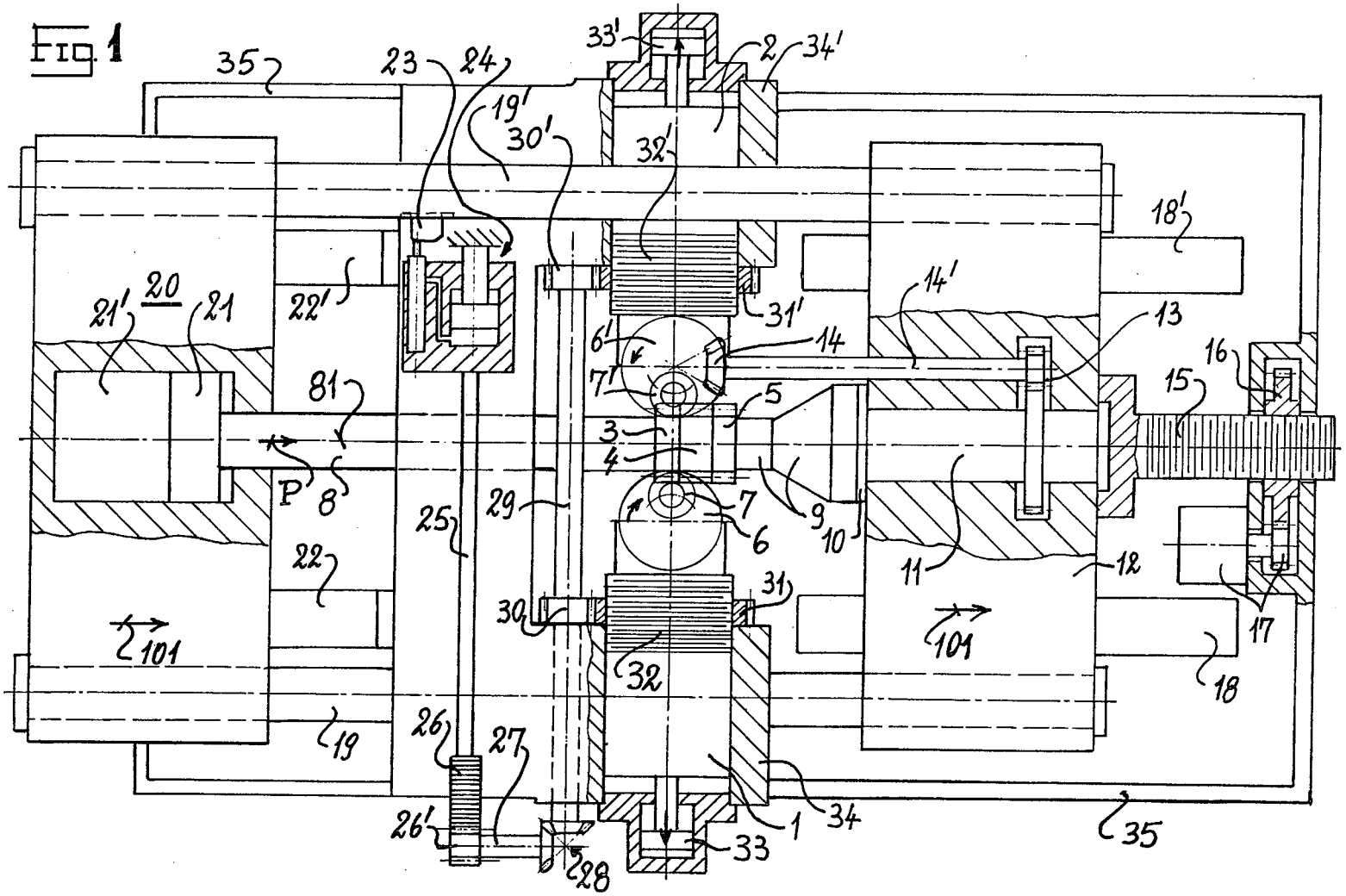
FIG. 1 is a schematic plan view, partially in section, illustrating an apparatus for fabricating toothed machine parts, typically gears, constructed according to the teachings of the present invention and useful for the practice of the method aspects thereof.

Initially, in order to facilitate the understanding of the invention there will be partially listed hereinafter the various components constituting the apparatus:

| | |
|---|---|
| 1 | Generating or rolling head |
| 2 | Generating or rolling head |
| 3 | Press punch (moving along) |
| 3' | Press punch contour |
| 4 | Workpiece |

-continued

| | |
|---|---|
| 4' | Finished workpiece contour |
| 4" | Raw workpiece contour |
| 5 | Press punch (driven) |
| 5' | Press punch contour (shape identical to the press punch contour 3') |
| 6 | Generating roll support for the rolling or generating head 1 |
| 6' | Generating roll support for the rolling or generating head 2 |
| 7 | Generating roll for generating roll support 6 |
| 7' | Generating roll of generating roll support 6' |
| 8 | Press mandrel for press punch 3 |
| 9 | Press mandrel for press punch 5 |
| 10 | Thrust bearing or block for press mandrel 9 at workpiece headstock 12 |
| 11 | Workpiece spindle for driving press mandrel 9 |
| 12 | Workpiece headstock for workpiece spindle 11 |
| 13 | Spindle drive (dividing gearing) for workpiece spindle 11 |
| 14 | Bevel gearing for driving spindle drive 13 with synchronous movement derived from generating roll support 6' by means of connection shaft 14' |
| 14' | Connection shaft of spindle drive 13 and bevel gearing 14 |
| 15 | Feed spindle for displacing workpiece headstock 12 upon guides 18 and 18' |
| 16 | Feed nut of feed spindle 15 (with outer toothed rim for drive by means of the feed drive 17) |
| 17 | Feed drive |
| 18 | Guide for workpiece headstock 12 at the machine frame or stand 35 |
| 18' | Guide analogous to the guide 18 |
| 19 | Tension or tie rod for the rigid interconnection of workpiece headstock 12 and counter-holder or counter-support 20 |
| 19' | Tension or tie rod analogous to tie rod 19 |
| 20 | Counter-holder (counter-support for press punch 3) |
| 21 | Press piston arranged in counter-holder 20 for pressing press punch 3 towards press punch 5 by means of workpiece 4 |
| 21' | Cylinder of press piston 21 |
| 22 | Guide of counter-holder 20 at machine frame or stand 35 |
| 22' | Guide analogous to guide 22 |
| 23 | Templet for copying device 24 |
| 24 | Copying device |
| 25 | Thrust rod of copying device 24 |
| 26 | Gear rack arranged at thrust rod 25 |
| 26' | Pinion driven by gear rack 26 |
| 27 | Pinion shaft of pinion 26' of bevel gearing 28 |
| 28 | Bevel gearing between pinion shaft 27 and connection shaft 29 |
| 29 | Connection shaft |
| 30 | Adjustment or setting pinion mounted upon connection shaft 29 and in engagement with adjustment nut 31 |
| 30' | Adjustment or setting pinion mounted upon connection shaft 29 and in engagement with adjustment nut 31' |
| 31 | Adjustment nut for generating or rolling head 1 |
| 31' | Adjustment nut for generating or rolling head 2 |
| 32 | External threading at rolling or roller head 1 for adjustment nut 31 |
| 32' | External threading at rolling or roller head 2 for adjustment nut 31' |
| 33 | Return piston arranged in machine frame 35 for rolling head 2 for pressing adjustment nut 31' at roller or rolling head support 34' |
| 34 | Roller or rolling head support at machine frame 35 for roller or rolling head 1 |
| 34' | Roller or rolling head support at machine frame 35 for roller or rolling head 2 |
| 35 | Machine stand or machine frame |
| 40 | Sleeve (fixed in press punch 3) |
| 41 | Sleeve for guiding entrainment bolt 43 |
| 42 | Rubber sleeve between sleeves 40 and 41 |
| 43 | Entrainment bolt for aligning the press punches 3 and 5 |
| 50 | Projection of press punch 5 for engagement in bore 90 |
| 51 | Spring ring mounted at projection 50 for compensating diameter differences between projection 50 and bore 90 |
| 52 | Bore in projection 50 for entrainment bolt 43 |
| 53 | Ejector bolt arranged in press punch 5 |
| 54 | Ring rib of press punch 5 |
| 54' | Ring rib of press punch 3 |
| 60 | Centering ring |
| 61 | Bevel or chamfer at contour 4" of workpiece 4 |
| 70 | Brow of workpiece 4 engaging in press punch contour 3' and press punch contour 5' |
| 80 | Surfaces of workpiece 4 vertical or perpendicular to the workpiece axis 81 |
| 81 | Workpiece axis of workpiece 4 |
| 90 | Bore in workpiece 4 |

The apparatus of the invention illustrated by way of example in FIG. 1 will be seen to comprise a machine stand or machine frame 35 at which there are mounted all of the components or parts which are movable relative to one another. The roller or rolling head supports 34 and 34' for the generating or rolling heads 1 and 2 are rigidly secured at the machine frame 35 in such a manner that the rolling heads 1 and 2 are displaceable vertically with respect to the lengthwise axis 81 of the workpiece 4. In order to bring about such displacement there is provided at each roller or rolling head 1 and 2 external threading 32 and 32', respectively, at which there is synchronously adjustable a respective nut 31 and 31' provided with teeth at its external circumference or periphery, by means of a respective adjustment pinion 30 and 30' via the connection shaft 29. So that the nuts or nut members 31 and 31' snugly bear against the associated roller head supports 34 and 34', respectively, each rolling head 1 and 2 is connected with a piston 33 and 33', respectively, movable in the machine frame 35, and working in the direction of the associated arrow. The shaft 29 either can be rotated manually for a certain fixed adjustment or setting, or, however, it can be adjusted continuously during the rolling operation during the course of the rolling work by means of the copying or copier device 24, which scans the copying templet 23. For this purpose the copier or copying device 24 is connected with a thrust or push rod 25 which carries at its one end a gear rack 26. This gear rack 26 drives a pinion 26' which, in turn, rotates the pinion shaft 27 and thus the bevel gearing 28. This bevel gearing 28, in turn, drives the shaft 29 of the gears 30 and 30'. It is possible by virtue of this continuous adjustability of the rolling heads 1 and 2 to produce both a desired change in shape at the rolled gear as well as also for the formation of undesired changes in shape. By virtue of the fact that the workpiece 4 is prestressed or biased between the hard press punches 3 and 5, their parts neighboring the press punches 3 and 5 cannot deform in the same manner as the intermediate region remote from the press punches 3 and 5. Also differences can arise between the part of the workpiece 4 machined at the start of the rolling operation and the part of the workpiece 4 which is worked towards the end of the rolling operation.

Figure 3:
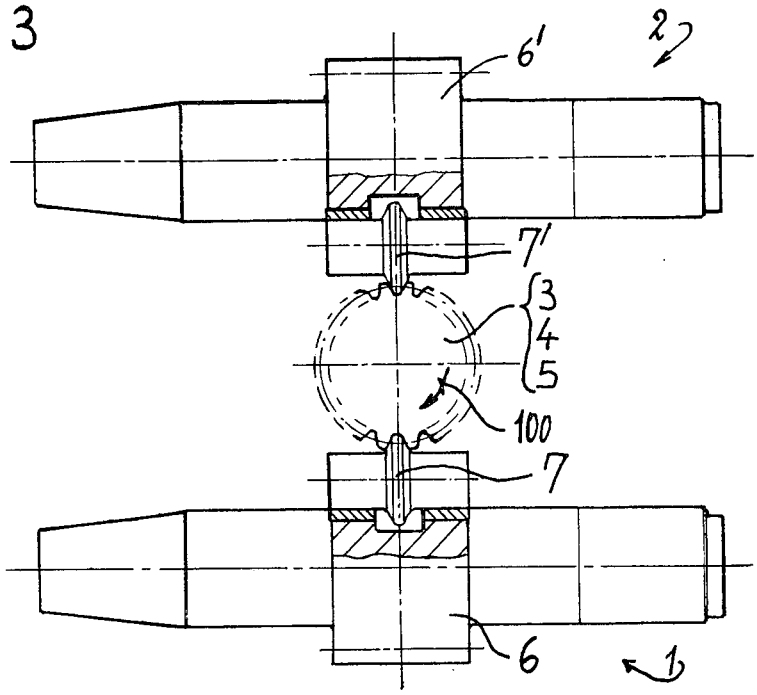
FIG. 3 is a further schematic cross-sectional view, taken substantially along the line III—III of FIG. 2.

At the rolling head 1 there is mounted the generating roll support 6 where there is arranged the generating roll 7 and at the rolling head 2 there is mounted the generating roll support 6' with its generating roll 7'. The roll supports 6 and 6' can be driven by a motor so as to revolve synchronously in the direction of the associated arrows, and the generating rolls 7 and 7' machine or process the surface of the workpiece 4 in the manner previously described, and as such has also been disclosed in detail in German Pat. No. 1,016,222. Hence, during each revolution of the generating roll supports the workpiece 4 is advanced, in the showing of FIG. 1, from the right towards the left along the workpiece axis 81 and at the same time further rotated or indexed through one tooth in the direction of the arrow 100 shown in FIGS. 3 and 5. The individual points of attack of the generating rolls or tools 7 and 7' are thus each accomplished along a helical- or screw-like path of travel extending about the workpiece and which is determined by the feed movement along the workpiece axis 81 and by the rotational movement 100.

Figure 2:
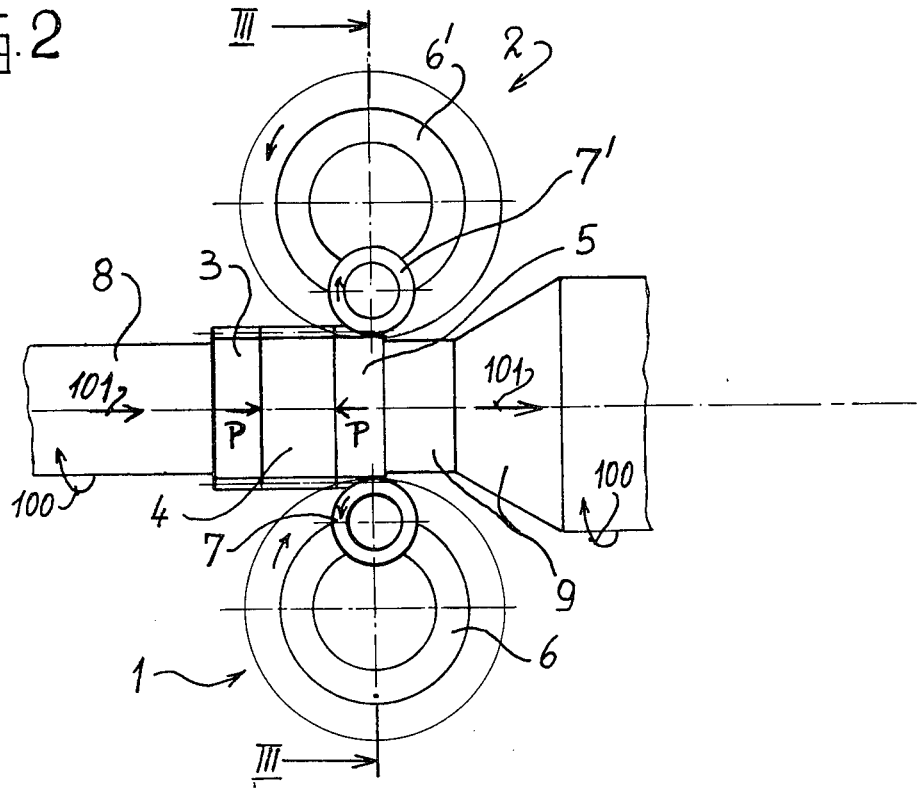
FIG. 2 is an enlarged view in relation to FIG. 1, showing schematically the press punches with the workpiece located therebetween and also schematically the roller or rolling heads at the beginning of the rolling operation.

In order to produce the prestress between the press punches 3 and 5, indicated by the arrows P in FIG. 2, the following procedures are carried out:

The press punch 5 is supported by means of a press mandrel 9 rigidly connected for rotation therewith and a thrust or pressure bearing 10 at the workpiece headstock 12. The workpiece headstock 12 is supported, in turn, by the feed spindle 15 through the agency of the feed nut 16 and the feed drive 17 at the machine frame 35. In order that there is exactly accomplished the lengthwise feed movement along the workpiece axis 81 which is transmitted from the workpiece-feed drive 17 by means of the feed spindle 15 to the headstock 12 and from such via the press mandrel 9 and the press punch 5 to the workpiece 4, the workpiece headstock 12 is additionally mounted by means of the guides 18 and 18' at the machine frame 35.

The workpiece headstock 12 is rigidly connected with the counter-holder or counter-support 20 by means of both of the tie or tension rods 19 and 19', the counter-support 20 being mounted to be displaceable in the machine frame 35 upon the guides 22 and 22' along the workpiece axis 81. The press mandrel 8 which is connected with the other press punch 3 is constructed as the piston rod of an hydraulic piston 21 which is mounted to be displaceable in the counter-support 20 along the workpiece axis 81 and freely rotatable about such workpiece axis 81. If a suitable pressurized fluid medium, such as pressurized oil, is introduced into the cylinder 21', then the piston 21 together with the press mandrel 8 and the press punch 3 are moved in the direction of the arrow P in FIG. 1 from the left towards the right and pressed against the workpiece 4 which is supported in the described manner by means of the press punch 5 at the machine frame 35. The movement which emanates from the workpiece-feed spindle 15, and which has already been described, has been indicated in FIG. 1 by the arrows 101 at the workpiece headstock 12 and the counter-support 20 in order to show that both of these components or parts are interconnected by the tension or tie rods 19 and 19' for the simultaneous unidirectional movement, which therefore is also transmitted to the workpiece 4 which is clamped between the press punches 3 and 5. This workpiece 4, during the course of the machining or processing work, thus is moved from the right towards the left and at the end of the machining operation is located in the position shown in FIG. 1. Due to these operations there is obtained a clean straight course of the teeth, because the previously described rotation of each workpiece part, which is in the process of being machined, is located opposite the already machined workpiece part in this manner when the punch 3 is not driven, and which can partially rotate in relation to the contact punch 5 in a manner still to be described.

It is for this reason that it is possible to also accomplish the rotational drive of the workpiece 4 by means of the contact punch 5 inasmuch as the contact punch 5 is rigidly connected for rotation with the press mandrel 9 and such with the spindle 11 and by means of a dividing gearing 13 — here shown in simplified illustration — there can be accomplished the partial drive, which gearing 13 can be synchronously driven by means of the bevel gearing 14 from the roll support 6' by means of the shaft 14'. Of course, there can be provided at such drive, exactly as in the feed drive 17, infinite or finite settable gearing means in order to properly accommodate to one another the feed movement 101 and the rotational movement 100 of the workpiece 4. This gearing means or gearing can be constructed in conventional manner.

Figure 4:
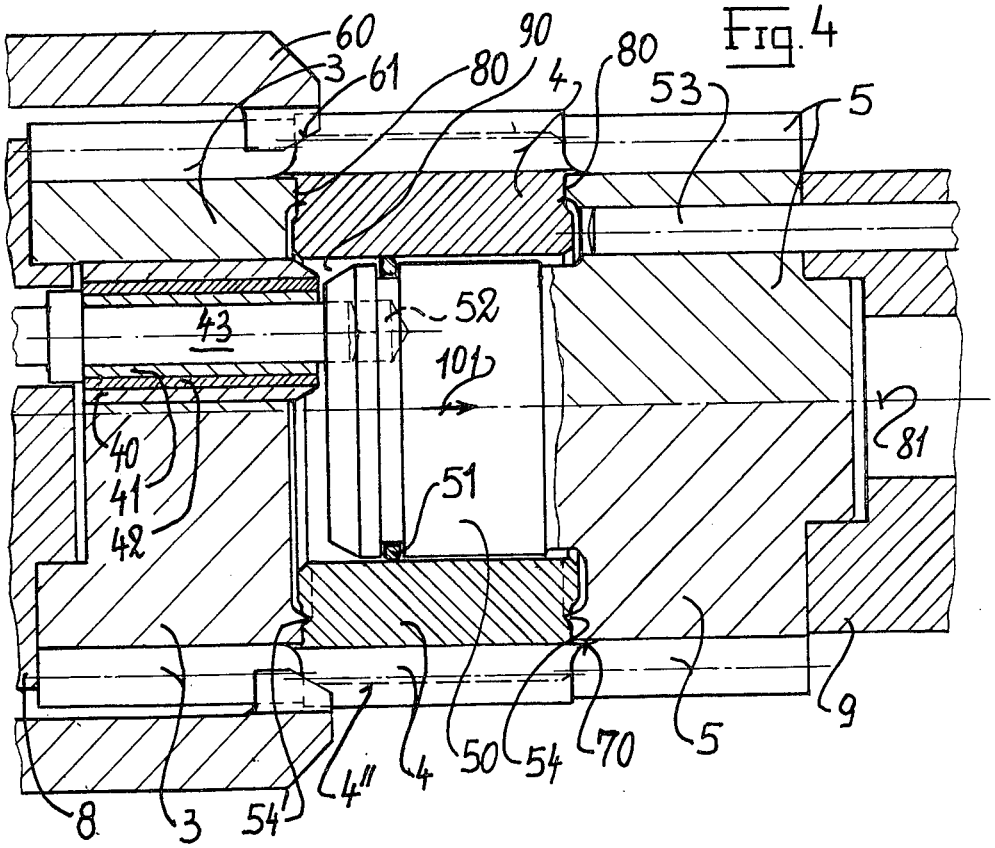
FIG. 4 is an enlarged longitudinal section through the press punches and the workpiece held therebetween in its clamped or chucked position.

Continuing, and with attention directed to FIG. 4, there will now be described more fully the clamping or chucking of the workpiece 4. Located upon the press mandrel 9 is the press punch 5 possessing the projection 50 which can be introduced with play into the bore 90 of the raw workpiece or blank 4, and centering can be accomplished by means of the spring ring 51. Prior to placement upon the projection 50 of the press punch 5 the workpiece 4 is faced or turned along its raw or rough contour 4'', and its end confronting the other press punch 3 is bevelled in a ring-shaped manner such has been indicated generally in FIG. 4 by reference character 61. The exact centering of the workpiece 4 in relation to the press punch 5 now is accomplished in that a centering ring 60 is pushed onto the workpiece from the left towards the right, comes into contact with the ring-shaped bevel 61 and the workpiece is thus centered. Now the second press punch 3, which is mounted upon its press mandrel 8, is fixedly pressed against the workpiece 4 by means of the piston 21 which has been previously considered in detail in conjunction with the description of FIG. 1, so that the workpiece is prestressed between the press punches 3 and 5. In order that the workpiece 4, in this prestressed position, is seated firmly and non-shiftably, both of the press punches 5 and 3 possess substantially ring-shaped protruding ribs 54 and 54', respectively, which penetrate into the workpiece 4. Viewed radially and located externally of such ribs 54 and 54' there are formed the reference surfaces 80 during the course of the rolling operation, which reference surfaces are needed for the subsequent further machining of the finished rolled workpiece. The surfaces 80 are dispositioned vertically, i.e. perpendicular to the workpiece axis 81.

Since both of the press punches 3 and 5 possess the contours 3' and 5', respectively, shown in FIG. 5, which are toothed similar to the later formed teeth of the finished workpiece, indicated by reference character 4' in FIG. 5, it is necessary that both press punches 3 and 5 are aligned with one another. To accomplish such alignment the entrainment bolt 43 is resiliently mounted in the press punch 3 by means of yet to be described sleeves 40, 41 and 42, in such a manner that during contact of the press punch 3 at the workpiece 4 this bolt 43 penetrates into the bore 52 of the projection 50 of the press punch 5 when the teeth of the press punches 3 and 5 coincide with one another. Only at this point in time does the press punch 3 bear completely at the workpiece 4, as such has already been described. As also disclosed heretofore, now since however there occurs a certain rotation of the material and thus the workpiece 4 due to the intermittent engagement or attack of the generating rolls 7 and 7' which is accomplished along a helical line, and which material rotation is maintained in the depicted order of magnitude in the range of fractions of a millimeter, the bolt 43 is slightly elastically mounted by means of the rubber sleeve 42 which is positioned between the other sleeves 40 and 41, so that it can permit a slight rotation of the press punch 3 in relation to the press punch 5. Consequently, there is provided in the already described manner the compensation for a good aligned extent of the teeth.

Figure 5:
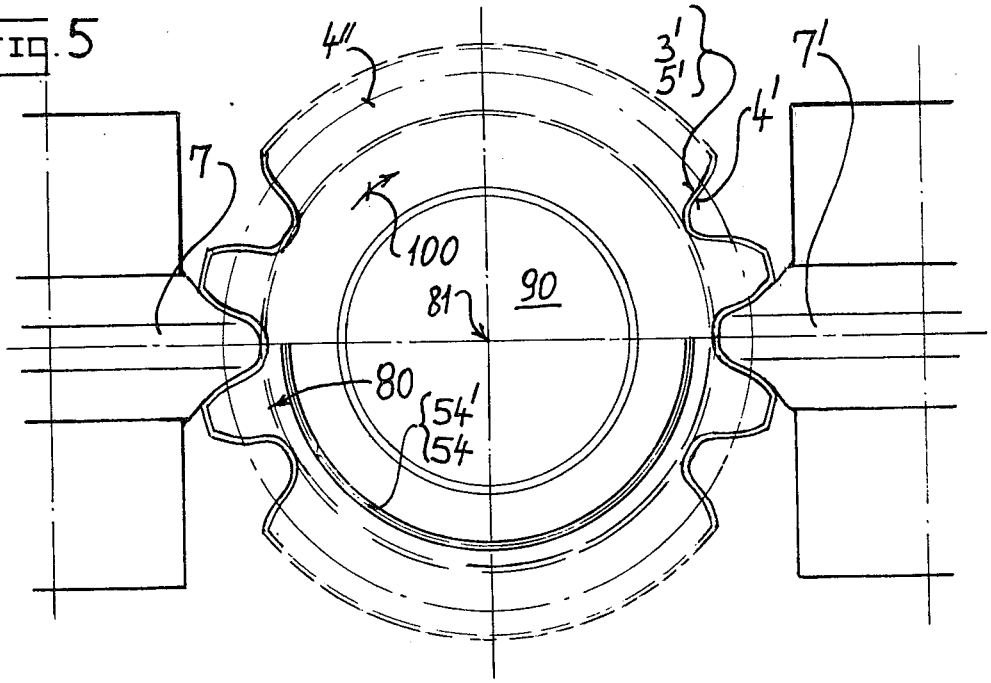
FIG. 5 is a still further schematic illustration, somewhat on the scale of FIG. 4, showing the outline of a gear, a press punch and two generating rolls in engagement with the gear.

As will be seen by referring to FIG. 5, it is necessary in most instances to maintain the contours 3' and 5' of the press punches 3 and 5, respectively, somewhat smaller than the contour 4' of the teeth of the workpiece 4 which are to be produced, in order that the generating rolls 7 and 7' can sufficiently deeply penetrate into the material of the workpiece 4, in order to give such the possibility of resiliently moving somewhat into its definitive shape, which has been shown in FIG. 5. These slightly smaller contours 3' and 5' of the press punches 3 and 5, respectively, now however render possible that a small quantity of material can penetrate into the teeth of the press punches 3 and 5 during rolling of the portions of the workpiece 4 which are near to the end surfaces and to form so-called brows or burrs which are designated by reference character 70 and appear at the lower right-hand corner of the workpiece 4 in FIG. 4. These brows 70 can be easily removed however after the ejection of the workpiece 4 by the ejector bolt or ejector means 53, following completion of the rolling operation and shifting away of the press punch 3. Furthermore, there are also provided ejectors in the press punch 3, but the same have not been particularly shown in order to simplify the illustration.

The reference surfaces 80, which have been considered a number of times heretofore, have been found to be especially useful even for the removal of the brows or burrs 70, while they are indispensible for grinding out the bore 90 of the gear. They provide the possibility of exactly aligning the gear upon further processing machines.

As a general rule the reference surfaces 80 are highly polished and compact, because they extend to the region of the workpiece flanks, which is at the end of the teeth and at their direct region, in other words at that location where the material is caused to flow due to the rolling operation, so that such is capable of forming at the correspondingly machined hardened surface of the press punch the true or exact reference surfaces 80.

While there are shown and described present preferred embodiments of the invention, it is to be distinctly understood that the invention is not limited thereto, but may be otherwise variously embodied and practiced within the scope of the following claims.

Accordingly, we claim:

1. A method of manufacturing straight or inclined toothed machine elements, especially spur gears, by cold working, comprising the steps of:

retaining under axial prestress an individual gear-workpiece blank which is in a cold condition during a cold rolling operation between two press punches in order to essentially prevent any appreciable flow of material of the blank in its axial direction and at such a pressure that under the action of the cold rolling operation there occur pressure stresses between the press punches and the workpiece, these pressure stresses corresponding to at least the elastic limit of the material of the workpiece; and forming at least at one of both end surfaces of the workpiece an end surface disposed exactly perpendicular to the lengthwise axis of the workpiece due to the simultaneous action of the prestressing force and the rolling operation.

2. The method as defined in claim 1, including the steps of:

accommodating in size and shape the surfaces of the press punches coming into contact with the workpiece in accordance with the prestressing force.

3. The method as defined in claim 1, further including the steps of:

utilizing press punches each having a tooth contour substantially equally divided similar to the teeth of the workpiece which is to be manufactured;

the outer dimensions of such tooth contour of the press punches at most being the same size as the outer dimensions of the contour of the teeth of the workpiece to be manufactured.

4. The method as defined in claim 1, further including the steps of:

utilizing press punches which possess at their respective surface which comes into contact with the workpiece at least one projection.

5. The method as defined in claim 4, wherein:

said at least one projection is in the form of a substantially ring-shaped rib.

6. The method as defined in claim 1, further including the steps of:

displacing the workpiece along its lengthwise axis in order to produce the teeth by cold working the workpiece and rotating such workpiece about its lengthwise axis;

processing the workpiece from externally thereof by means of at least one substantially ring-like profiled generating roll which is rotatably mounted in a revolving rolling head;

carrying out with each generating roll in a rapid sequence accommodated to the teeth division and the feed of the workpiece briefly effective individual rolling operations in the same directional sense extending predominantly in the lengthwise direction of the tooth profile, to thereby apply next to one another by means of the same generating roll successive individual rolling operations along a substantially screw-like shaped zone of the workpiece surface in the peripheral direction thereof and which screw-like shaped zone is determined by the workpiece feed; and accomplishing in the tooth profile lengthwise direction successive individual rolling operations which are carried out in overlapping fashion with respect to their engagement at the workpiece in such a manner that during the individual rolling operations material of the workpiece is displaced along a relatively small lengthwise section of the workpiece in predominantly radial direction.

7. The method as defined in claim 6, further including the steps of:

driving one of the press punches to feed the workpiece;

initiating the rolling operation at that end of the workpiece which is closest to the press punch transmitting such workpiece feed; and rotating the other press punch relative to the driven press punch through a limited region during the course of the rolling operation.

8. The method as defined in claim 1, further including the steps of:

employing rolling heads for carrying out the rolling operation; and altering the advancement of the roller heads with respect to the workpiece during the course of the rolling operation.

9. The method as defined in claim 1, wherein:

said prestressing of said individual gear-workpiece blank while in a cold condition entails urging said two press punches against opposite end faces of said blank and into contact with the related end surface thereof through an angle extending through 360°.

10. The method as defined in claim 1, further including the steps of:

using press punches having spaced teeth extending about the periphery thereof for exerting said axial prestress upon said individual gear-workpiece blank.

11. An apparatus for manufacturing straight or inclined toothed machine elements, especially spur gears, by cold working, comprising:

two press punches for holding therebetween with axial prestress an individual gear-workpiece blank during a cold rolling operation at opposite end faces of the blank and over an angle extending through 360° at each such blank end face and at such a pressure that there is essentially prevented axial flow of the material of the blank and under the action of the rolling operation there occur pressure stresses between the work punches and the workpiece corresponding at least to the elastic limit of the material of the workpiece; and means for axially chucking the workpiece between said two press punches.

12. The apparatus as defined in claim 11, further including:

means for displacing the workpiece along its lengthwise axis and for rotating said workpiece about said lengthwise axis;

at least one revolvingly driven rolling head;

at least one planetary-like mounted generating roll for machining the workpiece and mounted at said revolvingly driven rolling head;

means for revolvingly driving said rolling head;

means for coordinating the movement of the workpiece and the generating roll; and said means for chucking the workpiece in axial direction being provided at the means for displacing said workpiece.

13. The apparatus as defined in claim 12, further including:

a machine frame;

said means for displacing said workpiece comprising:

a headstock movably mounted at said machine frame;

axial feed means for displacing the headstock along the lengthwise axis of the workpiece;

a spindle rotatable about the lengthwise axis of the workpiece in the headstock;

said spindle being rigidly connected for rotation with one of the press punches;

pressure bearing means provided at said headstock, said pressure bearing means taking-up pressure forces acting upon said one press punch along the lengthwise axis of the workpiece;

tension rod means;

counter-support means;

said tension rod means rigidly connecting said headstock with said counter-support means but allowing movement thereof together with said counter-support means;

press means provided for said counter-support means for moving the other press punch along the lengthwise axis of the workpiece.

14. The apparatus as defined in claim 12, further including:

adjustment means for regulating the penetration depth of each generating roll at the workpiece.

15. The apparatus as defined in claim 12, further including:

resilient guide means provide for one of the press punches;

bolt means displaceably guided in the resilient guide means of said last-mentioned one punch;

said bolt means aligning both of the press punches in a work position.

16. The apparatus as defined in claim 12, further including:

centering ring means displaceable substantially parallel and coaxially at one of the press punches in the direction of the other press punch;

said centering ring means centering the workpiece during clamping thereof between the press punches.

17. The apparatus as defined in claim 11, wherein:

each of said press punches comprises a toothed press punch having teeth spaced about the periphery thereof.

* * * * *